United States Patent [19]

Urabe

[11] Patent Number: 4,983,484

[45] Date of Patent: Jan. 8, 1991

[54] ARSENIC-SELENIUM PHOTOSENSITIVE MATERIAL FOR USE IN ELECTRONIC PHOTOGRAPHY

[75] Inventor: Kazuyuki Urabe, Matumoto, Japan

[73] Assignee: Fuji Electric Co., Ltd., Japan

[21] Appl. No.: 454,722

[22] Filed: Dec. 21, 1989

[30] Foreign Application Priority Data

Dec. 22, 1988 [JP] Japan ..... 63-324334

[51] Int. Cl.[5] ..... G03G 5/082

[52] U.S. Cl. ..... 430/86

[58] Field of Search ..... 430/85, 86

[56] References Cited

U.S. PATENT DOCUMENTS 3,906,228 9/1975 Lange ..... 430/86 X 4,770,965 9/1988 Fender et al. ..... 430/86 X

*Primary Examiner*—J. David Welsh

*Attorney, Agent, or Firm*—Brumbaugh, Graves, Donohue & Raymond

[57] ABSTRACT

A photosensitive material for use in electronic photography having a photosensitive layer principally comprises an amorphous selenium-arsenic alloy, the alloy having present therein crystalline arsenic trioxide in the form of arsenolite and claudetite. The charging ability of the photosensitive material is improved by controlling the ratio of relative absorbance peak intensity in the infrared spectrum of arsenolite to claudetite to be at least 0.5.

8 Claims, 1 Drawing Sheet

FIG. 1
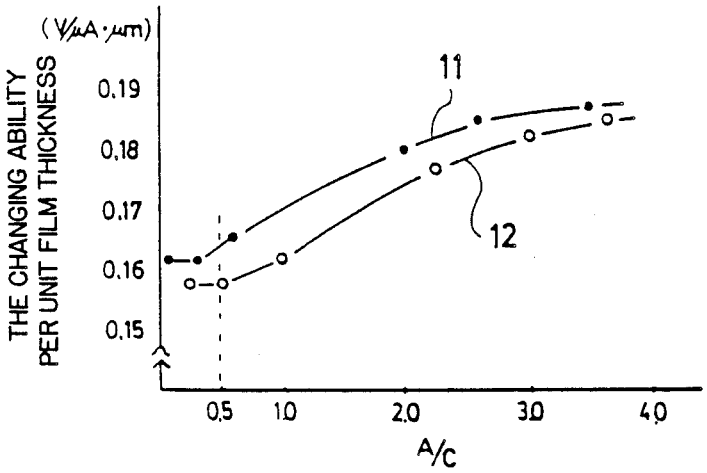
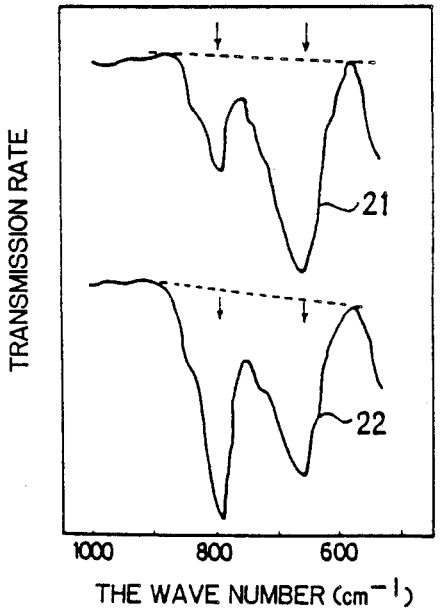
FIG. 2

ARSENIC-SELENIUM PHOTOSENSITIVE MATERIAL FOR USE IN ELECTRONIC PHOTOGRAPHY

BACKGROUND OF THE INVENTION

The present invention relates to a photosensitive material for use in electronic photography having a photosensitive layer comprising a selenium arsenic alloy. A photosensitive material of this type is used in electronic photography equipment such as plain paper copying machines and the like, and is generally characterized by a photosensitive layer deposited on a conductive substrate, such as an aluminum alloy.

During operation of the above described electronic photography equipment, the surface of the photosensitive layer is uniformly charged by corona discharge in a darkened environment. The surface of the layer is then exposed to a picture image, and the electric potential present acts to create an electrostatic latent image on the surface. Toner then adheres to the electrostatic latent image, and the image is thereafter transferred to a paper sheet and fixed thereto by heat or pressure to become a permanent copied image. The toner remaining on the surface of the photosensitive layer is removed in a cleaning process utilizing a fur brush and blade. The remaining charge (potential) is removed by AC discharge and/or optical discharge to prepare for the beginning of the next cycle.

There is, however, a problem that exists. The photosensitive layers tend to have varying charge potentials due to the varying corona discharge of the photosensitive materials used. This is the case even where the photosensitive layers have the same composition and same film thickness. The result is that the charging ability per unit film thickness varies for different layers produced. This causes a great problem with respect to quality control, for if the charging ability is too low, the contrast of the picture image will deteriorate. The charging ability per unit film thickness is represented by the formula $$V_o/I_{pc}.L$$

where the charge potential is represented by $V_o$, the current flowing into the substrate is $I_{pc}$, and the film thickness is L.

It is thus an object of the present invention to provide a photosensitive material which avoids the variation in charging ability per unit film thickness by controlling the photosensitive layer through conditions other than the composition or the film thickness.

SUMMARY OF THE INVENTION

In order to solve the above described problem, the present invention comprises a photosensitive material having a photosensitive layer comprising a selenium arsenic alloy as the main component. The selenium arsenic alloy contains a quantity of arsenic trioxide ($As_2O_3$), which is present in at least two crystalline forms: arsenolite, which crystallizes in the isometric system, and claudetite, which crystallizes in the monoclinic system. The structures of these two crystals reflect the structure of the Se-As alloy, and have a close relationship to the electric properties thereof. The charging ability per unit film thickness is controlled by observing the ratio of relative absorbence peak intensity of arsenolite to claudetite (arsenolite/claudetite or "A/C ratio"). It has been found that consistent and superior charging ability can be maintained if the A/C ratio of the selenium arsenic photosensitive layer is controlled at a value of 0.5 or greater.

BRIEF DESCRIPTION OF THE DRAWINGS

FIG. 1 is a graph showing the relationship between the charging ability per unit film thickness of the amorphous $As_2Se_3$ photosensitive layer and the structure of the $As_2O_3$ in the photosensitive layer, represented by the ratio A/C of arsenolite to claudetite.

FIG. 2 is a graph of the Fourier transform infrared absorption spectra of two different samples of amorphous $As_2Se_3$.

DESCRIPTION OF THE PREFERRED EMBODIMENT

FIG. 2 shows the curves 21 and 22 of the Fourier transform infrared absorption spectra for two different samples of $As_2Se_3$. For both materials, there are two absorption peaks at the same position on the respective curves. The peak at a wave number of about 790 $cm^{-1}$ corresponds to the peak of arsenolite, and the peak at a wave number of about 650 $cm^{-1}$ corresponds to the peak of claudetite. When the ratio of the peak values of arsenolite and claudetite (A/C) is greater than 0.5, the charging ability becomes greatly enhanced.

In a specific embodiment, a photosensitive layer comprising amorphous $As_2Se_3$ containing 1000 ppm of iodine is formed on a conductive substrate by using two different samples of selenium as starting materials. The correlation between the charging ability per unit film thickness and the A/C ratio of the $As_2Se_3$ in the film was examined where the $V_o$ is about 900 V, $I_{pc}$ is about 100 $\mu$A, and L is about 60 $\mu$m. The results are shown in FIG. 1 respectively as curves 11 and 12. In both samples, the charging ability per unit thickness becomes large when the A/C ratio exceeds 0.5. At a A/C ratio of greater than 3.0., the charging ability becomes superior, and allows for much greater contrast in the picture image. Furthermore, at this ratio, the adjusting operation in the case of an exchange of the photosensitive material can be shortened.

The ratio between arsenolite and claudetite can be controlled by varying the temperature and/or pressure during the deposition of the arsenic sellenium alloy photosensitive layer. For example, with a substrate temperature of 220° C., an A/C ratio of about 2.0 was obtained, while an A/C ratio of about 3.0 was obtained with a substrate temperature of 180° C.

Though the above embodiment contains iodine as an additive to the $As_2Se_3$, this is not meant as a limitation, and all additives known to be effective to those skilled in the art are contemplated. Other effective photosensitive materials have a photosensitive layer comprising an Se-As alloy having 15 to 50 weight % arsenic, and other halogens or metals such as Sb as additives. Photosensitive materials of these types are also amenable to control of the charging ability by monitoring the A/C ratio as described above.

I claim:

1. A photosensitive material for use in electronic photography comprising a photosensitive layer which principally comprises an amorphous selenium-arsenic alloy, said alloy having present therein crystalline arsenic trioxide in the form of arsenolite and claudetite, wherein the amounts of arsenolite and claudetite are such that the ratio of the infrared absorbance peak at about 790 $cm^{-1}$ to the peak at about 650 $cm^{-1}$ is at least 0.5.

2. The photosensitive material of claim 1, wherein the ratio is at least 3.0.

3. The photosensitive material of claim 1, wherein arsenic is present in the alloy in an amount of 15 to 50 weight %.

4. The photosensitive material of claim 3, wherein the alloy further comprises a halogen.

5. The photosensitive material of claim 4, wherein the halogen is iodine.

6. The photosensitive material of claim 5, wherein the idione is present in the amount of approximately 1000 ppm.

7. The photosensitive material of claim 3, wherein the alloy further comprises a metallic additive.

8. The photosensitive material of claim 7, wherein the metal is Sb.

* * * * *